United States Patent [19]

Hollmann

[11] Patent Number: 5,067,203

[45] Date of Patent: Nov. 26, 1991

[54] CARD CLOTHING

[75] Inventor: Frank P. Hollmann, Ramsdorf, Fed. Rep. of Germany

[73] Assignee: Peter Wolters AG, Rendsburg, Fed. Rep. of Germany

[21] Appl. No.: 558,862

[22] Filed: Jul. 27, 1990

[30] Foreign Application Priority Data

Jul. 27, 1989 [DE] Fed. Rep. of Germany ..... 3924890

[51] Int. Cl.[5] ..... D01G 15/84

[52] U.S. Cl. ..... 19/114

[58] Field of Search ..... 19/114, 115

[56] References Cited

U.S. PATENT DOCUMENTS 4,357,738 11/1982 Siegeist ..... 19/114

FOREIGN PATENT DOCUMENTS 292679 1/1914 Fed. Rep. of Germany ..... 19/114
2052898 7/1973 Fed. Rep. of Germany ..... 19/114
0112033 6/1984 Japan ..... 19/114
1201022 9/1986 Japan ..... 19/114
7859 of 1906 United Kingdom ..... 19/114
20162 of 1912 United Kingdom ..... 19/114

*Primary Examiner*—Werner H. Schroeder
*Assistant Examiner*—John J. Calvert
*Attorney, Agent, or Firm*—Herbert Dubno

[57] ABSTRACT

A card clothing for a yarn carder flat has a card fillet and tooth members with tooth shanks projecting from the fillet and the connector between tooth shanks perpendicular to a travel direction of the fiber. According to the invention the relatively large offsets between the tooth members of one diagonal group from gasps in that diagonal group in which tooth shanks from an overlapping diagonal group are positioned in this direction so that, in spite of large offsets, the alleys formed in the card cloth are comparatively narrow. The diagonal groups can have even numbers of tooth rows and thus odd numbers of offsets.

6 Claims, 2 Drawing Sheets

CARD CLOTHING

FIELD OF THE INVENTION

My present invention relates to a card clothing for a card of the type in which tooth members are received in a card fillet and each of the tooth members has two projecting tooth shanks connected by a transverse member lying generally transverse, in turn, to the fiber travel direction.

BACKGROUND OF THE INVENTION

A card clothing of the type in which a multiplicity of tooth members, as described, are mounted in the card fillet so that the tooth shanks project therefrom, can have the teeth so offset from one another that the members lie in diagonal groups, the offset between corresponding teeth of successive members is constant and the diagonal tooth groups partly overlap one another in the fiber travel direction.

To ensure that the roving or sliver which is formed from the fiber will be comparatively fine as a result of the carding operation, it is recognized that it is important to minimize the widths of the alleys between the offset teeth.

This means, of course, that attempts have been made to make the offset as small as possible.

In the past, this effort has confronted the problem that attempts to provide very small offsets have resulted in an unsatisfactory distribution of the teeth per unit area. The distribution in these cases has been found to be especially disadvantageous for the card clothing of flats in which the offset is very small and thus the number of teeth rows relatively to the flat width is very large.

OBJECTS OF THE INVENTION

It is the principal object of the present invention to provide a card clothing for flats of the aforedescribed type so that even with a relatively large offset, relatively small alley widths can be achieved.

Another object of the invention is to provide an improved card clothing for flats whereby drawbacks of earlier systems are avoided.

SUMMARY OF THE INVENTION

These objects and others which will become apparent hereinafter are attained, in accordance with the invention in a card clothing for a yarn carder, especially for flats, which comprises:

a card fillet; and a multiplicity of tooth members set into the card fillet and each being formed with two tooth shanks projecting from the card fillet and a connecting element interconnecting the shanks and lying transverse to a yarn-travel direction upon carding of yarn with the card clothing in the yarn carder, the tooth members being arrayed with their tooth shanks parallel to one another in a plurality of diagonal groups each consisting of a multiplicity of mutually parallel tooth members staggered transversely to the direction and with a constant offset (v) perpendicular to the direction between successive tooth members of each group so that corresponding first tooth shanks of the members lie on one side of each group and corresponding second tooth shanks of the members lie on an opposite side of each group, the first tooth shanks of a group being offset transverse to the direction relative to successive first tooth shanks of the same group in the direction by the constant offset (v), the groups being inclined to the direction and at least partly overlapping neighboring ones of the groups in the direction, the tooth members of the groups lying in respective tooth rows perpendicular to the direction, for an even number of the tooth rows and a correspondingly odd number of offsets of tooth members between the tooth rows of the even number, a first or second tooth shank of a leading tooth member of each of the groups with respect to the direction being in line in the direction only with a respective first or second tooth shank of a trailing member of the even number of tooth rows of a neighboring group and with no other tooth shank within the even number of tooth rows.

Thus the objects of the invention are achieved by providing the offset of such magnitude that for an even number of tooth rows and thus an uneven number of offsets of one diagonal tooth group, only the right or left tooth shank of the first or last tooth of this even number is directly aligned in the fiber travel direction with the right or left tooth shank of a last or first tooth of the even number of a neighboring diagonal tooth group.

This diagonal pattern differs from the diagonal pattern of German Industrial Standard DIN 64108 by the odd number of offsets. With the invention, therefore, the left tooth shank of the teeth of a leading tooth array in the fiber travel direction does not lie beneath the right tooth shank of a tooth of a trailing tooth row. As a consequence, in spite of a relatively large offset, I am able to ensure small alley widths with a uniform distribution of the teeth.

It has been found to be particularly advantageous that in the gap or offset between two neighboring teeth in one diagonal tooth group in the travel direction there lies a shank of a subsequent tooth and preferably centrally in this gap to break up the alley into two equal-width alleys of smaller widths.

Advantageously the card is formed in this direction with a plurality of sets of tooth members, each of the sets having its tooth members disposed in respective diagonal groups A leading one of the sets has its groups inclined with a greater pitch and thus a smaller angle $\beta_1$ with the direction than an angle $\beta_2$ formed by the groups of a trailing one of the sets and the direction.

BRIEF DESCRIPTION OF THE DRAWINGS

The above and other objects, features and advantages of my invention will become more readily apparent from the following description, reference being made to the accompanying highly diagrammatic drawing in which.

SPECIFIC DESCRIPTION

Figure 3:
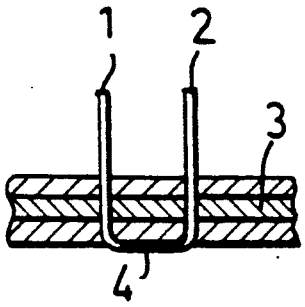
FIG. 3 is a section showing the flat clothing in the region of a tooth.

Each tooth of a flat clothing for a card (FIG. 3) comprises two tooth shanks 1, 2 projecting perpendicularly from the carrier material 3. On the backside of the carrier the two shanks 1 and 2 are interconnected by a transverse member 4. In application, this traverse always lies transverse or perpendicular to the fiber travel direction which has been represented by the arrow F.

Figure 2:
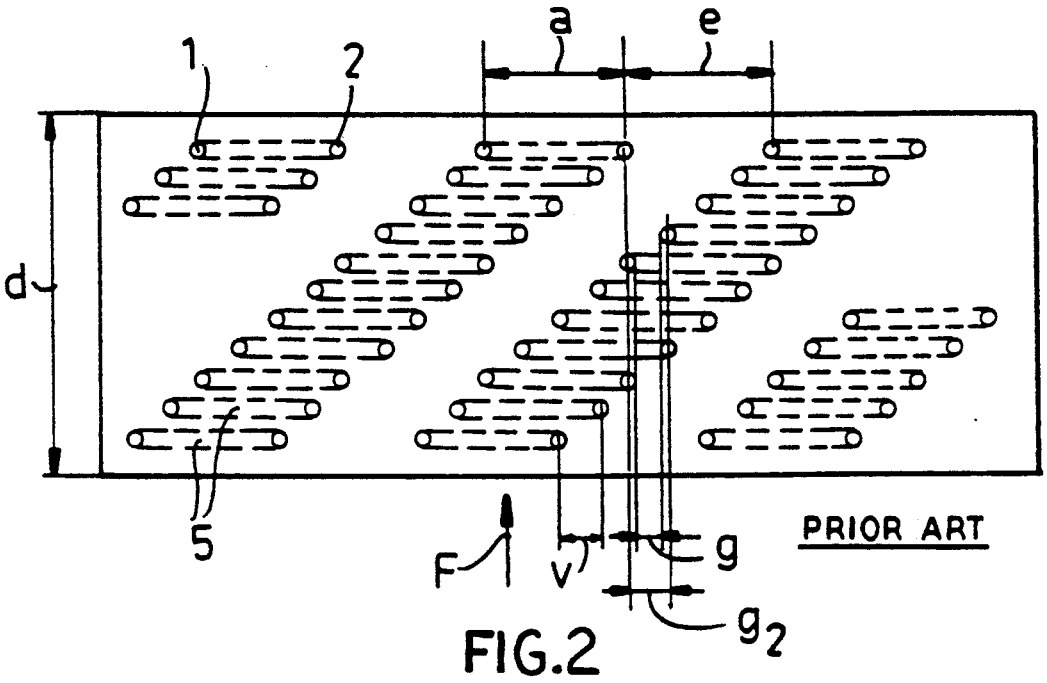
PRIOR ART FIG.2
FIG. 2 is a plan view of a card clothing of a flat representing the state of the art.

In the prior art card clothing shown in FIG. 2, the tooth shanks 1 and 2 of the teeth 5 of one diagonal tooth group 6 ar directly in line in the direction F with the shanks 1, 2 of a member diagonal tooth group so that alleys $g_2$ of a clear width g are generated. These alleys are of the same width throughout the card. The magnitudes $g_2$ and g are dependent upon the offset v so that, in this construction, it can be said that the offset directly determines the width of these alleys and thus, to ensure small alley widths, the offset must be selected to be correspondingly small.

Figure 1:
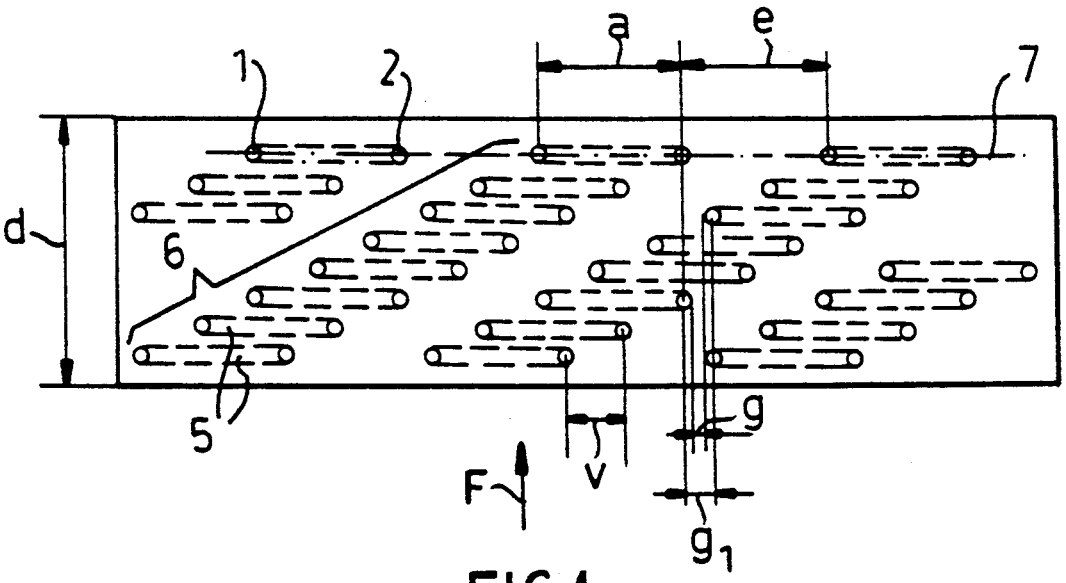
FIG. 1 is a plan view of a card clothing for a card flat according to the invention.
Figure 1A:
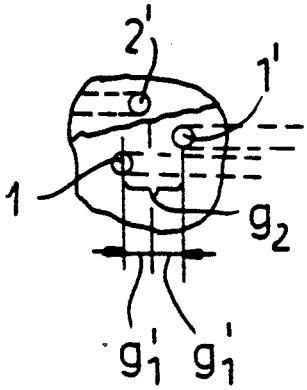
FIG. 1A is a diagram illustrating a relationship according to the invention.

In the card clothing of the invention, the teeth 1 and 2 which project from the card fillet and can be seen in FIG. 1 are offset from tooth row to tooth row with the offset being divided by the presence of a tooth from another diagonal group. The principle is here shown in FIG. 1A where the alley $g_2$ between two teeth 1 and 1' of successive tooth members in one diagonal group is split by the tooth shank 2' of another diagonal group so that the actual alleys formed have the widths $g_1'$ which can be less than half the width of the alley $g_2$.

According to the invention, the actual alleys formed in the array of teeth in the direction F of fiber travel are always narrower than the offset and in the case of the alley width $g_1$, may be a maximum of half this offset.

This can be achieved in that within the diagonal group there is always an even number tooth rows 7 and thus an uneven number of offsets. Within this group, a left or right tooth shank of the tooth member of a leading tooth row in the fiber travel direction F does not lie under the right or left tooth shank of one of the subsequent tooth rows of the same group so that in spite of a relatively large offset, narrow alleys are formed.

Figure 4:
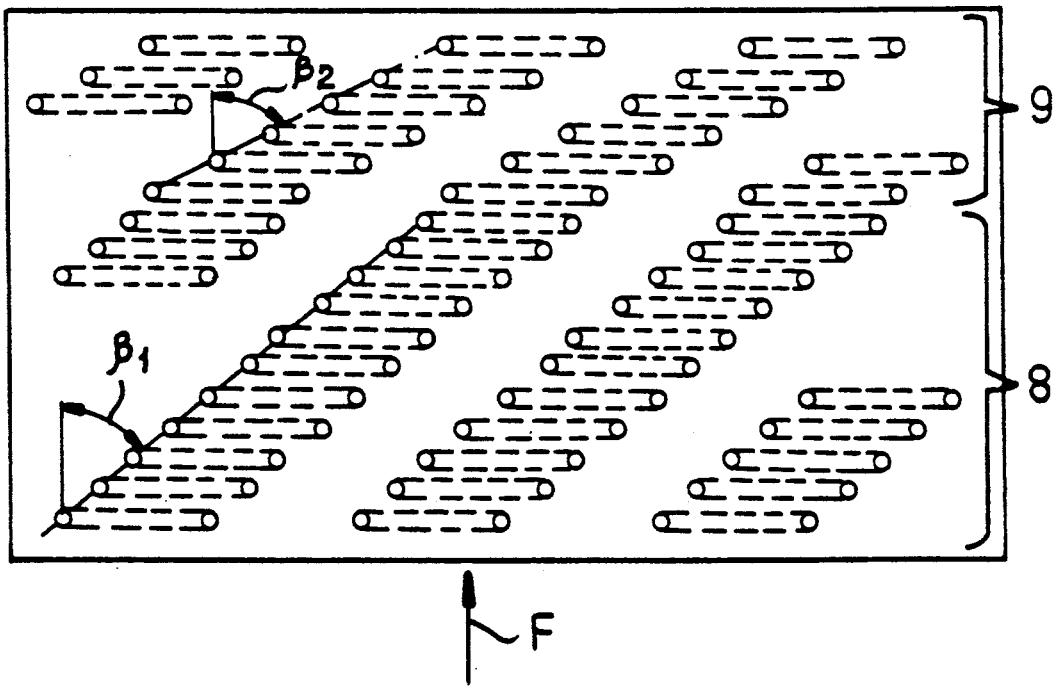
FIG. 4 is a plan view of a flat clothing utilizing two sets of diagonal groups of tooth members in accordance with a feature of the invention.

The card flat clothing shown in FIG. 4 comprises two sets of teeth with respective diagonal groups of different pitches, i.e. inclinations $\beta_1$ and $\beta_2$ to the fiber travel direction F. The leading group 8 has a smaller offset and thus a larger pitch than the trailing group 9 in the fiber travel direction F. In spite of the greater offset and the associated smaller pitch, however, the group 9 has smaller alleys in accordance with the principle of the invention as described above.

In the fiber travel direction in the card clothing of FIG. 4, in spite of a group wise reduction in pitch there is a group wise reduction in the alley width which has the effect, that in the leading group or set of teeth, with the wider alleys, coarser contaminants can be removed from the fiber while in the trailing group, because of the smaller alleys, finer contaminants can be removed.

I claim:

1. A card clothing for a yarn carder, comprising:

a card fillet; and a multiplicity of tooth members set into said card fillet and each being formed with two tooth shanks projecting from said card fillet and formed with a spacing a therebetween and a connecting element interconnecting said shanks and lying transverse to a fiber travel direction upon carding of fiber with the card clothing in said yarn carder, said tooth members being arrayed with their tooth shanks parallel to one another in a plurality of diagonal groups each consisting of a multiplicity of mutually parallel tooth members staggered transversely to said fiber travel direction and with a constant offset (v) perpendicular to said fiber travel direction between successive tooth members of each group so that corresponding first tooth shanks of said members lie on one side of each group and corresponding second tooth shanks of said members lie on an opposite side of each group, said first tooth shanks of a group being offset transverse to said fiber travel direction relative to successive first tooth shanks of the same group in said fiber travel direction by said constant offset (v), said groups being inclined to said fiber travel direction and at least partly overlapping neighboring ones of said groups is said fiber travel direction, neighboring groups being spaced from one another at a spacing e equal to said spacing a, said tooth members of said groups lying in respective tooth rows perpendicular to said fiber travel direction, for an even number of said tooth rows and a correspondingly odd number of offsets of tooth members between the tooth rows of the even number, a first or second tooth shank of a leading tooth member of each of said groups with respect to said fiber travel direction being in line in said fiber travel direction only with a respective first or second tooth shank of a trailing member of said even number of tooth rows of a neighboring group and with no other tooth shank within said even number of tooth rows.

2. The card clothing defined in claim 1 wherein two mutually offset corresponding tooth shanks of successive tooth members of one of said groups define a gap in said fiber travel direction there between and a tooth shank of a successive tooth member of a neighboring group is disposed in line with said gap in said direction.

3. The card clothing defined in claim 2 wherein said successive tooth member of a neighboring group disposed in line with said gap in said fiber travel direction is located substantially midway of said gap to subdivide said gap into two substantially equal width alleys running in said fiber travel direction.

4. The card clothing defined in claim 1 wherein said card is formed in said fiber travel direction with a plurality of sets of said tooth members, each of said sets having said tooth members disposed in respective diagonal groups, a leading one of said sets having its groups inclined with a greater pitch and thus a smaller angle $\beta_1$ with said fiber travel direction than an angle $\beta_2$ formed by the groups of a trailing one of said sets and said direction.

5. The card clothing defined in claim 4 wherein a first tooth shank of a group of said leading set is not in line in said fiber travel direction with a first tooth shank in said fiber travel direction of a group of said trailing set.

6. The card clothing defined in claim 1 wherein at least three of said groups have an even number of said members.

* * * * *